US007343651B2

(12) United States Patent
Niwa

(10) Patent No.: US 7,343,651 B2
(45) Date of Patent: Mar. 18, 2008

(54) BUCKLE

(75) Inventor: Kenji Niwa, Aichi (JP)

(73) Assignee: Merzen Products Inc., Aichi (JP)

( * ) Notice: Subject to any disclaimer, the term of this patent is extended or adjusted under 35 U.S.C. 154(b) by 0 days.

(21) Appl. No.: 11/650,946

(22) Filed: Jan. 9, 2007

(65) Prior Publication Data

US 2007/0214617 A1 Sep. 20, 2007

(30) Foreign Application Priority Data

Mar. 15, 2006 (JP) ..... 2006-070325

(51) Int. Cl.
*A44B 11/26* (2006.01)

(52) U.S. Cl. ..... 24/616; 24/635

(58) Field of Classification Search ..... 24/634, 24/635, 614–616, 625
See application file for complete search history.

(56) References Cited

U.S. PATENT DOCUMENTS 4,425,689 A * 1/1984 Fildan ..... 24/664
5,027,481 A * 7/1991 Frano ..... 24/606
6,446,314 B1 * 9/2002 Anscher ..... 24/614

FOREIGN PATENT DOCUMENTS

JP 2000-000106 A 1/2000

* cited by examiner

*Primary Examiner*—James R. Brittain
(74) *Attorney, Agent, or Firm*—Rader, Fishman & Grauer, PLLC

(57) ABSTRACT

A buckle is provided with a female member 5 having first and second engaging portions 13 and 14, and a male member 6 having first and second engagement pieces 20 and 21. By inserting the male member 6 into the female member 5, the first engaging portion 13 engages with the first engaging piece 20, and the second engaging portion 14 engages with the second engaging piece 21, thereby, female member 5 and male member 6 are connected. The male member 5 and female member 6 are not separated, unless engagement between first engaging piece 20 and first engaging portion 13, as well as engagement between second engaging piece 21 and second engaging portion 14, are released by means of both a first operating portion 11 and a second operating portion 12 which are separately provided on the front and rear of female member 5 being pressed inwardly.

4 Claims, 4 Drawing Sheets

BUCKLE

TECHNICAL FIELD AND RELATED APPLICATION

The present invention relates to a buckle which can connect the end portions of members in string form to each other and separate the two members in string form by releasing the engagement through a pressing operation. This application is claiming Paris Convention Priority based on Japanese Patent Application No. 2006-070325 filed Mar. 15, 2006, the contents of which, including specification, drawings and claims, are incorporated herein by reference in its entirety.

BACKGROUND TECHNOLOGY

There are conventional buckles of this type where a male member in plate form has an elastic piece (engaging piece) of which the end makes contact with the inner surface of a front plate portion of a female member in flat cylindrical form in an elastically deformed state as the male member is inserted into the female member, and the front plate portion of the female member is provided with a hooking portion (engaging portion) for hooking the end portion of the elastic piece in such a manner that an operating piece that is provided in the female member can be pressed inward through operation, and thereby, the elastic piece is elastically deformed in such a direction that the hooked (engaged) state with the hooking portion is released (see for example Patent Document 1).

[Patent Document 1] Japanese Unexamined Patent Publication 2000-106 (page 6, FIG. 19)

SUMMARY OF THE INVENTION

However, in the buckle described in Patent Document 1, the engaged state between the elastic piece (engaging piece) and the hooking portion (engaging portion) of the female member is released by pressing the operating piece of the front plate portion in the female member, and therefore, though the releasing operation is possible with one hand, there is a risk that the engaged state between the female member and the male member may be released without the user's intent when the operating piece is accidentally pressed or some object hits the operating piece, because the operating piece is provided only on the front plate portion side of the female member.

The present invention is provided taking into consideration this problem, and an object of the invention is to provide a buckle where an engaging piece of a male member and an engaging portion of a female member engage, and thereby, the male member and the female member become of a connected state, and the engagement between the engaging piece and the engaging portion can be prevented from being accidentally released, making the male member and the female member of a separated state.

In order to solve the above described problem, the buckle of the present invention is a buckle having a female member in approximately flat cylindrical form with a front plate portion and a rear plate portion with an opening created at one end, and a male member with an inserting portion for inserting into the above described female member through the above described opening formed at one end. A first engaging piece that can elastically engage a first engaging portion that is formed on the inside of the above described front plate portion, and a second engaging piece that can elastically engage a second engaging portion that is formed on the inside of the above described rear plate portion are formed on the above described inserting portion; a first operating portion that can be operated so that the above described first engaging piece is pressed from the outside and engagement with the above described first engaging portion is released is provided in the above described front plate portion, and a second operating portion that can be operated so that the above described second engaging piece is pressed from the outside and engagement with the above described second engaging portion is released is provided in the above described rear plate portion separately from the above described first operating portion, so that the above described male member and the above described female member do not become of a separated state unless engagement between the above described first engaging piece and the above described first engaging portion, as well as engagement between the above described second engaging piece and the above described second engaging portion, are released via both of the above described operating portion and the above described second operating portion. These characteristics prevent the connected state between the female member and the male member from being released without the user's intent, because even if one of the engagement between the first engaging piece and the first engaging portion or the engagement between the second engaging piece and the second engaging portion is accidentally released via either the first operating portion or the second operating portion which are individually provided to the front and rear of the female member, the other engagement is not released. In addition, the first operating portion and the second operating portion are provided in the front and rear of the female member, and therefore, the male member and the female member can be easily made of a separated state by pressing the two operating portions on the female member in the front-rear direction in such a manner as to pinch the female member from the two sides.

The above described first operating portion may be formed of a first operating piece that is provided in such a manner that the first operating piece can freely press the above described first engaging piece because of a slit created in the above described front plate portion, the above described second operating portion is formed of a second operating piece that is provided in such a manner that the second operating piece can freely press the above described second engaging piece because of a slit created in the above described rear plate portion, and the above described first engaging portion and the above described second engaging portion are formed of an inner peripheral surface of the above described slits. These characteristics may make molding of the buckle easy, because the front plate portion and the rear plate portion have a simple form in comparison with a case where the first engaging portion, the second engaging portion and the slits are separately created, and in addition, make it possible to release engagement between respective engaging portions and engaging pieces without fail, because each engaging portion is formed in the vicinity of an operating piece.

The above described first operating piece may be pressed outwards by the above described first engaging piece in an engaged state with the above described slit, and the above described second operating piece is pressed outwards by the above described second engaging piece in an engaged state with the above described slit. These characteristics make the operation of pressing the respective operating pieces easy, because in the state where the first engaging piece is engaged with the first engaging portion and the second engaging piece is engaged with the second engaging portion, the respective operating pieces are held in an outwardly pressed state, due to the elastic recoil of the respective engaging pieces, preventing the respective operating pieces from sinking inward into the female member.

The above described slits may be created in approximately circular form and the ends of the above described first engaging piece and the above described second engaging piece have a curved form with a curvature that is approximately the same as the curvature of the above described slits. These characteristics effectively prevent ricketiness in the connected state, because the engagement works to restrict movement of the male member in the direction of separation, and in addition, restrict movement in the left-right direction.

The above described first engaging piece and the above described second engaging piece may be formed by splitting the end portion of an elastic piece that is formed in the above described inserting portion into two branches in the front-rear direction. These characteristics effectively prevent engagement of one engaging piece with the engaging portion from being released when only the other engaging piece is pressed, because one engaging piece is pressed in such a direction as to be further engaged when only the other engaging piece is pressed through operation.

The above described female member and the above described male member may be formed in such a manner that the form of the front and rear is symmetrical in a cross section. These characteristics make the manufacture of a female member and a male member easy, and make it possible to insert the inserting portion into the female member when the front and rear of the male member are reversed, making use of the buckle easy.

BEST MODE FOR CARRYING OUT THE INVENTION

The best mode for implementing the buckle according to the present invention is described in the following on the basis of the embodiments.

EMBODIMENTS

Figure 1:
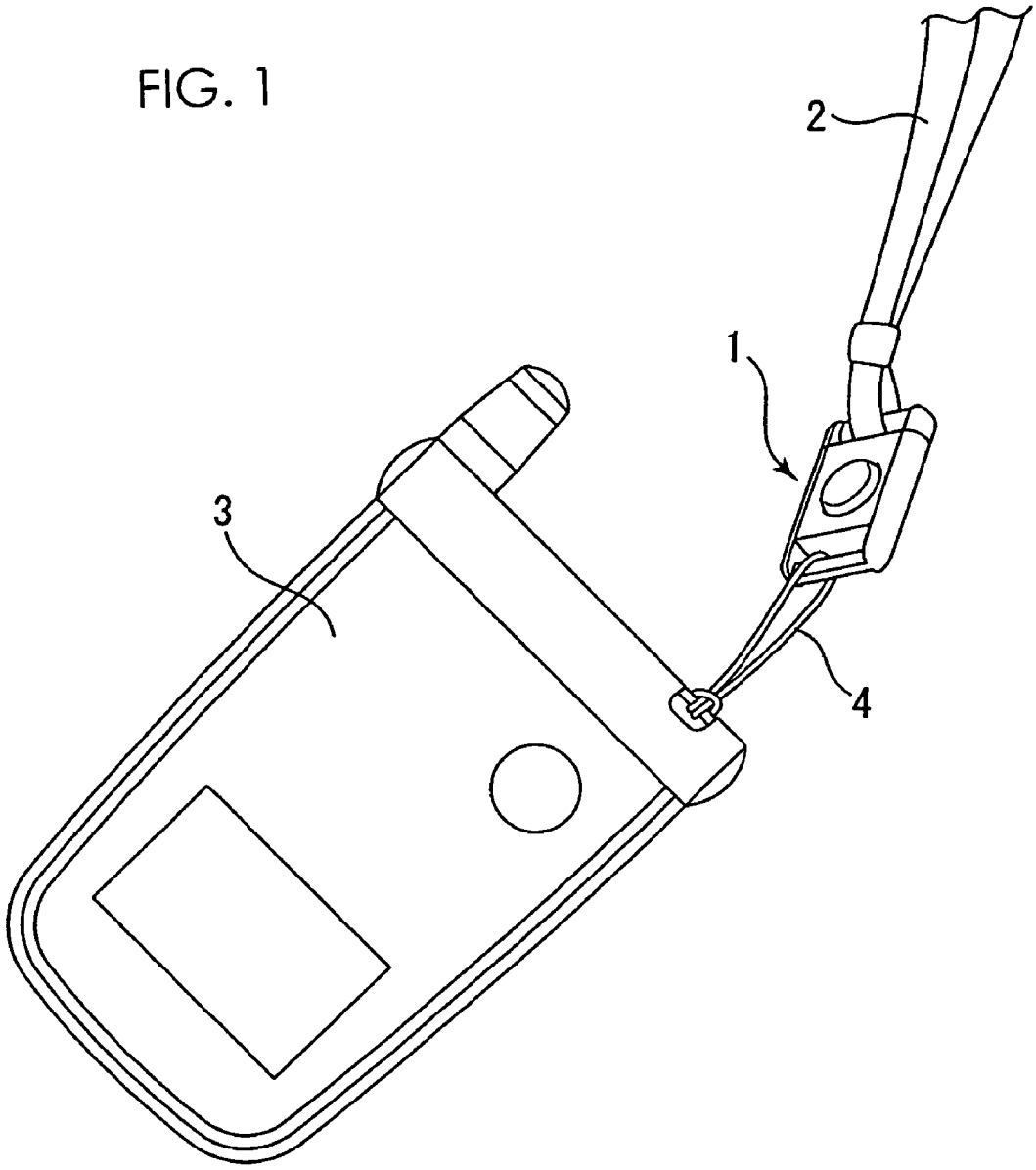
FIG. 1 is a perspective diagram showing a buckle according to an embodiment in a state of use.
Figure 2:
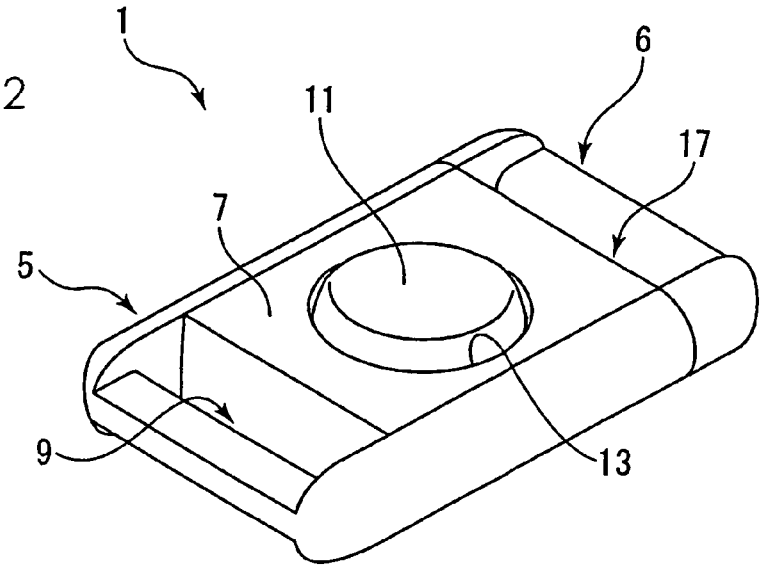
FIG. 2 is a perspective diagram showing the buckle in a connected state.
Figure 3:
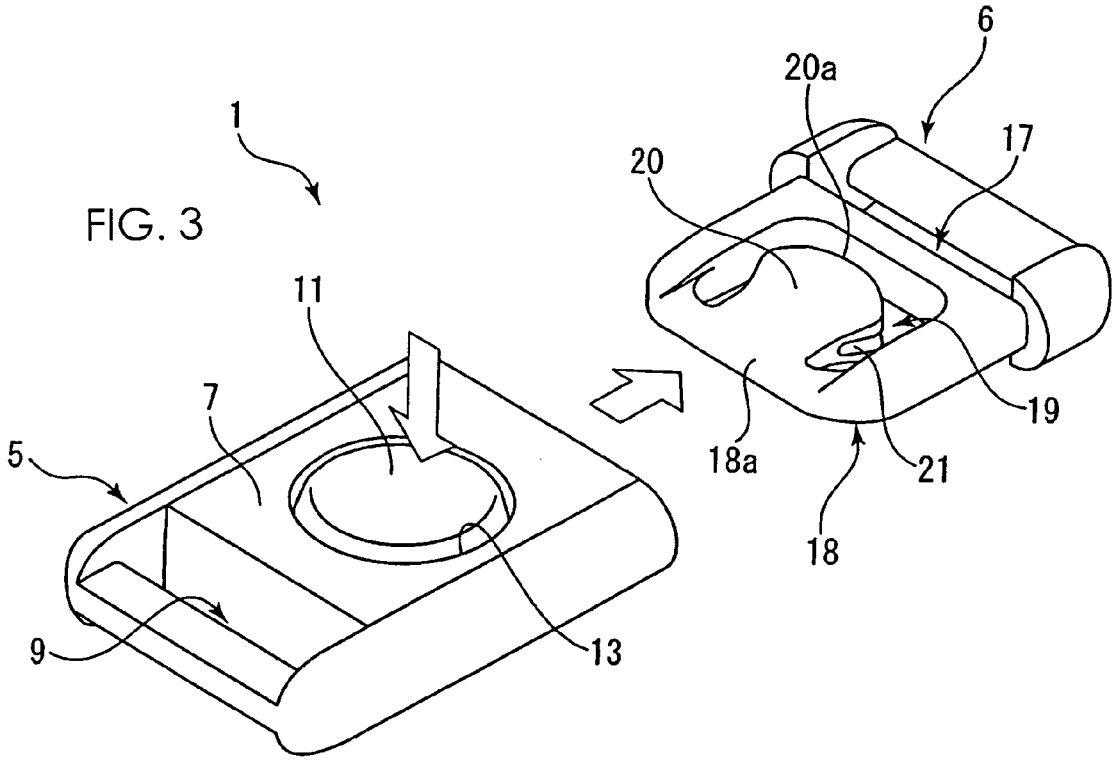
FIG. 3 is a perspective diagram showing the buckle in a separated state.
Figure 4:
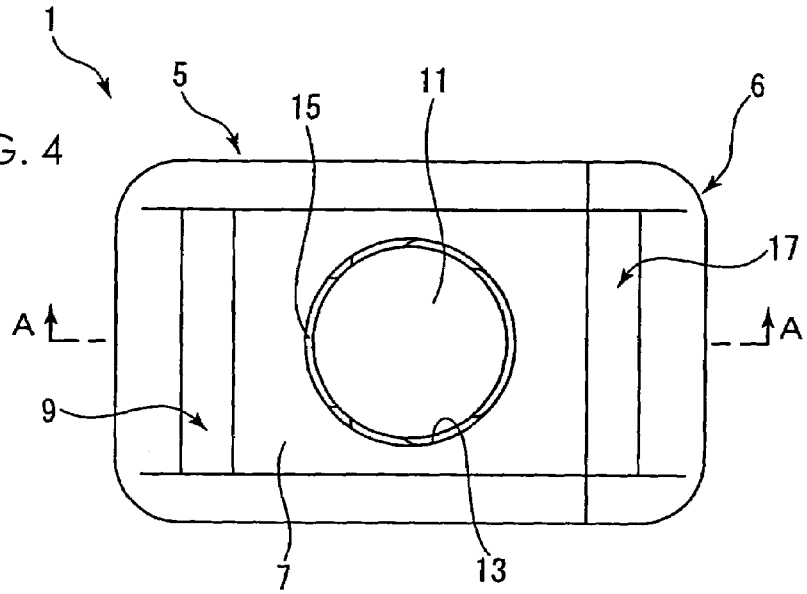
FIG. 4 is a front diagram showing the buckle in a connected state.
Figure 5:
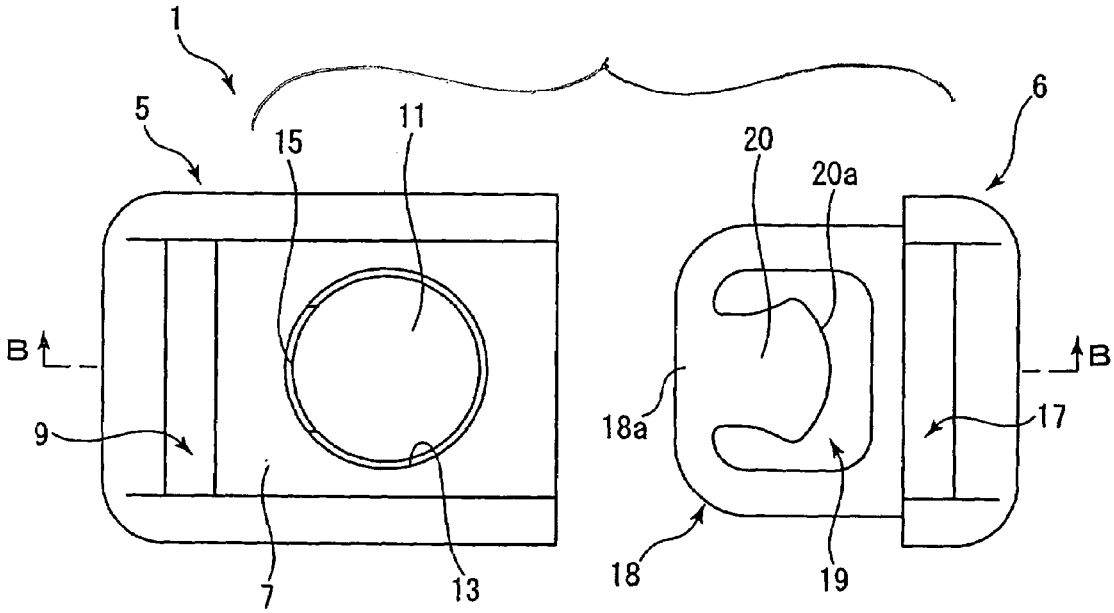
FIG. 5 is a front diagram showing the buckle in a separated state.
Figure 6:
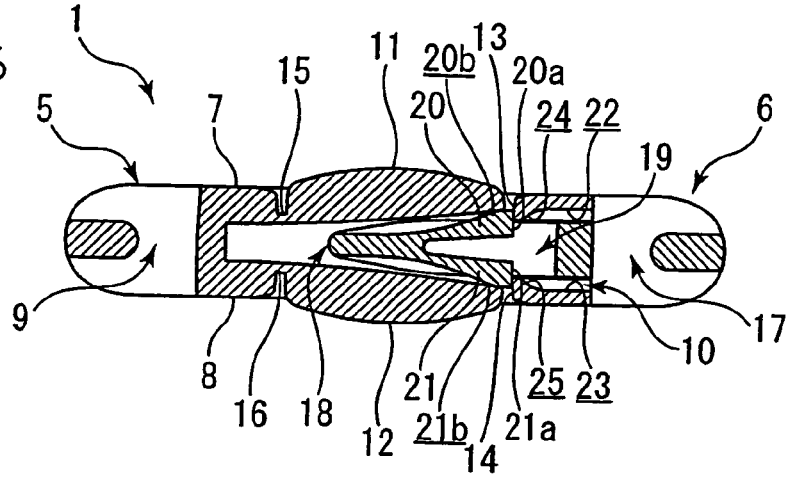
FIG. 6 is a longitudinal cross sectional side diagram showing the buckle along A-A of FIG. 4.
Figure 7:
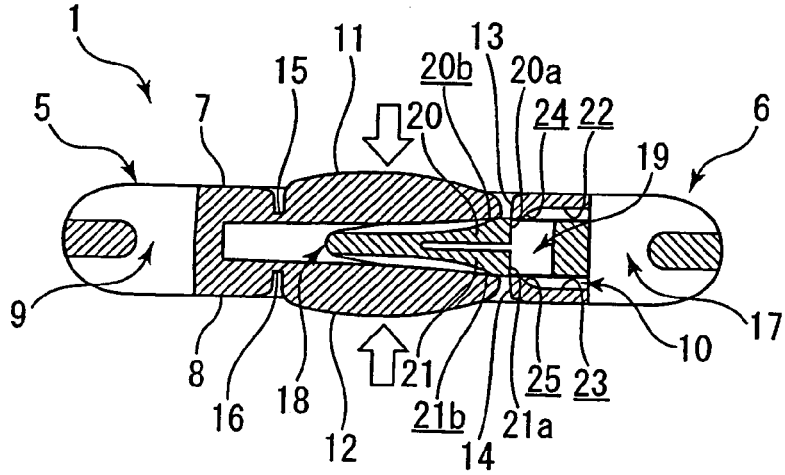
FIG. 7 is a longitudinal cross sectional side diagram showing the buckle in a state where the operating pieces are pressed.
Figure 8:
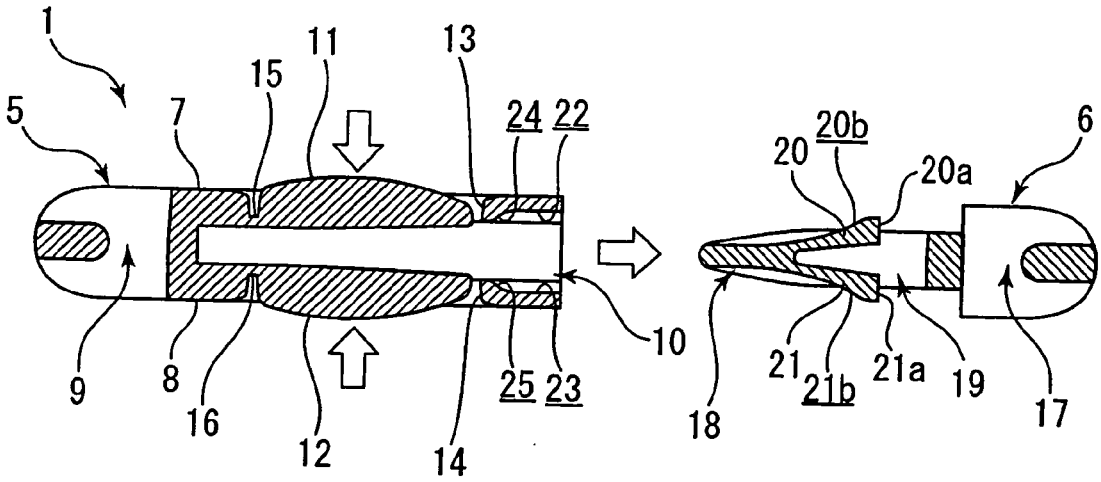
FIG. 8 is a longitudinal cross sectional side diagram showing the buckle along B-B of FIG. 5.

An embodiment of the present invention is described in reference to the drawings. First, FIG. 1 is a perspective diagram showing a buckle according to an embodiment in a state of use, FIG. 2 is a perspective diagram showing the buckle in a connected state, FIG. 3 is a perspective diagram showing the buckle in a separated state, FIG. 4 is a front diagram showing the buckle in a connected state, FIG. 5 is a front diagram showing the buckle in a separated state, FIG. 6 is a longitudinal cross sectional side diagram showing the buckle along A-A of FIG. 4, FIG. 7 is a longitudinal cross sectional side diagram showing the buckle in a state where the operating pieces are pressed, and FIG. 8 is a longitudinal cross sectional side diagram showing the buckle along B-B of FIG. 5. In the following description, the top of the paper in FIGS. 2, 3, 6, 7 and 8 is the front side of the buckle, and the front side of the paper in FIGS. 4 and 5 is the front side of the buckle.

Symbol 1 in FIG. 1 indicates a buckle to which the present invention is applied, and this buckle 1 is used to attach a cellular phone 3 or other objects for hanging to a strap 2 which is a member in string form that can be hung from the user's neck or wrist. In particular, a connecting string 4 is attached to one end of buckle 1 as a member in string form that is attached to cellular phone 3, and strap 2 is attached to the other end of buckle 1.

As shown in FIGS. 2 and 3, buckle 1 is formed of a female member 5 in approximately flat cylindrical form and a male member 6 that can be connected to this female member 5. Female member 5 has a front plate portion 7 that is formed on the front side and a rear plate portion 8 (see FIG. 6) that is formed on the rear side, and a hole for attachment 9 is created at one end of female member 5 so as to penetrate in the front-rear direction as a portion for attachment to which connecting string 4 is attached, while an opening 10 into which an inserting portion 18 of the below described male member 6 is inserted is created at the other end, on the side opposite to the end where hole for attachment 9 is created (see FIG. 8).

As shown in FIGS. 4 and 6, female member 5 and male member 6 that form buckle 1 have the same form on the front side and the rear side, and the form in a longitudinal cross section is symmetrical between the front and rear. Furthermore, the appearance, that is, the form, of buckle 1 in the state where female member 5 and male member 6 are connected has the same form in the left and right and the same form in the top and bottom.

Operating pieces 11 and 12 in approximately circular form are provided in the center portion of front plate portion 7 and rear plate portion 8 of female member 5, and slits 13 and 14 are created around the outer periphery of these operating pieces 11 and 12 in such a manner that these slits 13 and 14 penetrate into female member 5 toward the inside. Here, the inner peripheral surface of slit 13 that is created in front plate portion 7 forms a first engaging portion of the present invention, and the inner peripheral surface of slit 14 that is created in rear plate portion 8 forms a second engaging portion of the present invention.

In addition, joint portions 15 and 16 for joining operating pieces 11 and 12 to front plate portion 7 and rear plate portion 8 are formed in a portion of the outer periphery of operating pieces 11 and 12, and these joining portion s15 and 16 are formed in such a manner that the width of these in the front-rear direction is smaller than the width of front plate portion 7 and rear plate portion 8 in the front-rear direction, and the operating pieces 11 and 12 are moveable in the front-rear direction through elastic deformation with joint portions 15 and 16 as axes (see FIG. 8).

Here, operating pieces 11 and 12 are formed in approximately hemispherical form so that the center portion thereof bulges out, and the user can press the center portion of operating pieces 11 and 12, and thereby, press operating pieces 11 and 12 into female member 5 in the front-rear direction. As described below, engaging pieces 20 and 21 are elastically deformed when operating pieces 11 and 12 are pressed, and thus, female member 5 and male member 6 are released from the connected state.

Meanwhile, as shown in FIGS. 5 and 8, a hole for attachment 17 is formed at one end of male member 6 so as to penetrate in the front-rear direction as a portion for attachment to which strap 2 is attached. In addition, an inserting portion 18 for inserting into female member 5 through opening 10 of female member 5 is formed at the end of male member 6 on the side opposite to the end where hole for attachment 17 is created.

A through hole 19 is created in the center portion of inserting portion 18, and two engaging pieces 20 and 21 in approximately fan form as viewed from the front are provided so as to extend from the inner periphery of through hole 19 into through hole 19 and overlap in the front-rear direction. These two engaging pieces 20 and 21 are placed in approximately V form as viewed from the side in a cross section, as shown in FIGS. 6 to 8, and engaging piece 20 that is placed on the front side forms the first engaging piece of the present invention and engaging piece 21 that is placed on the rear side forms the second engaging piece of the present invention.

Concretely, the end portion of an elastic piece (engaging piece) which is provided so as to extend from a side portion 18*a* (see FIG. 5) of inserting portion 18 in square frame form in the center of which through hole 19 is formed into through hole 19 at the center is formed so as to split into two branches in the front-rear direction, and thereby, engaging pieces 20 and 21 are formed. That is to say, these engaging pieces 20 and 21 are integrated at the base portion and formed so as to incline in the direction in which they split toward the end portion.

In addition, the end portions of engaging pieces 20 and 21 have engaging end portions 20*a* and 21*a* formed as an edge curved with the same curvature as that of slits 13 and 14, so that the end portions of engaging pieces 20 and 21 can engage with the inner peripheral surface of slits 13 and 14, and engaging end portions 20*a* and 21*a* in curved form engage with the inner peripheral surface of slits 13 and 14 of front plate portion 7 and rear plate portion 8 in a state where female member 5 and male member 6 are connected.

Furthermore, the front surface 20*b* of engaging piece 20 (see FIG. 6) is formed as an inclined surface which gradually inclines toward the front side in the direction from the side portion 18*a* side into through hole 19, that is to say, from the end on the side on which female member 5 is inserted into male member 6 to the other end, and the rear surface 21*b* of engaging piece 21 (see FIG. 6) is formed as an inclined surface which gradually inclines toward the rear side in the direction from the side portion 18*a* side into through hole 19, that is to say, from the end on the side on which female member 5 is inserted into male member 6 to the other end.

As shown in FIG. 8, parallel guide surfaces 22 and 23 are formed so as to be parallel to each other in the vicinity of opening 10 on the inner surface side of front plate portion 7 and rear plate portion 8 of female member 5, and inclined guide surfaces 24 and 25 are formed so as to incline and spread from the inner side to the outer side (the other end side) of female member 5.

As shown in FIGS. 6 to 8, when female member 5 and male member 6 are connected, the user pinches female member 5 and male member 6 in the vicinity of holes for attachment 9 and 17, respectively, so that female member 5 and male member 6 come close to each other, and inserts inserting portion 18 into female member 5 through opening 10.

Parallel guide surfaces 22 and 23 are thus formed in female member 5, and when inserting portion 18 of male member 6 is inserted through opening 10, inserting portion 18 is guided with engaging pieces 20 and 21 following parallel guide surfaces 22 and 23, and furthermore, when engaging pieces 20 and 21 make contact with inclined guide surfaces 24 and 25, engaging pieces 20 and 21 are elastically deformed so as to come close to each other in the front-rear direction, while inserting portion 18 is inserted into female member 5.

As shown in FIG. 5, when engaging pieces 20 and 21 pass over inclined guide surfaces 24 and 25, engaging pieces 20 and 21 recover their form due to elastic recoil in the front-rear direction, so that engaging pieces 20 and 21 move away from each other, and engaging end portions 20*a* and 21*a* in the front and rear engage the inner peripheral surface of slits 13 and 14 of front plate portion 7 and rear plate portion 8. As a result, movement of male member 6 in such a direction as to move away from female member 5 is restricted, and male member 6 and female member 5 become of a connected state (see FIG. 6).

Here, slits 13 and 14 are in circular form, and when engaging end portions 20*a* and 21*a* engage with the inner peripheral surface of these slits 13 and 14, movement of male member 6 in such a direction as to move away from female member 5 is restricted, and in addition, ricketiness of male member 6 in the left-right direction relative to female member 5 (FIG. 4, top-down direction on paper) can be prevented.

In addition, as shown in FIG. 6, when female member 5 and male member 6 are in a connected state, the ends of operating pieces 11 and 12 at the front and rear make contact with front surface 20*b* of engaging piece 20 and rear surface 21*b*, respectively. At this time, the bulging center portion of operating piece 11 that is provided in front plate portion 7 is formed so as to protrude to the front side from front plate portion 7 in such a manner that the extent of this protrusion is greater than the degree of deformation in engaging piece 20 on the front side when this engaging piece is elastically deformed in the front-rear direction. In the same manner, the bulging center portion of operating piece 12 that is provided in rear plate portion 8 is formed so as to protrude to the rear side from rear plate portion 8 in such a manner that the extent of this protrusion is greater than the degree of deformation in engaging piece 21 on the rear side when this engaging piece is elastically deformed in the front-rear direction.

Furthermore, the ends of operating pieces 11 and 12 make contact with front surface 20*b* of engaging piece 20 and rear surface 21*b*, and thereby, as shown in FIG. 6, the ends of operating pieces 11 and 12 are pressed outward due to the elastic recoil of engaging pieces 20 and 21, the ends of operating pieces 11 and 12 are prevented from sinking inward into female member 5 (sagging toward the front), and the center portions of operating pieces 11 and 12 are in such a state as to bulge outward from the surface of front plate portion 7 and rear plate portion 8, and thus, the pressing operation of engaging pieces 20 and 21 using operating pieces 11 and 12 becomes easy.

Here, slits 13 and 14 are created around the outer periphery of operating pieces 11 and 12 in circular form, and joint portions 15 and 16 are formed so as to be axes for the movement of operating pieces 11 and 12, and thereby, it becomes easy for operating pieces 11 and 12 to elastically deform inward into female member 5, and when the user releases the engaged state between engaging pieces 20 and 21 and slits 13 and 14 by pressing operating pieces 11 and 12 through operation, pressing operation can be carried out with little pressing force.

As shown in FIGS. 6 to 8, to separate female member 5 and male member 6, the user pinches operating pieces 11 and 12 of female member 5 in the front-rear direction with his fingers, so that both operating pieces 11 and 12 are pressed inward into female member 5. Then, on the inside of female member 5, engaging pieces 20 and 21 at the front and rear are elastically deformed so as to come close to each other, and as a result, engagement between engaging end portions 20*a* and 21*a* of operating pieces 11 and 12 and the inner peripheral surface of slits 13 and 14 is released (see FIG. 7). In this state, front end portions 20*a* and 21*a* of operating pieces 11 and 12 make contact with the inclined surface of front surface 20*b* of engaging piece 20 and rear surface 21*b* of engaging piece 21, and thereby, the inward movement of front end portions 20*a* and 21*a* creates a force that presses out engaging pieces 20 and 21, that is to say, in such a direction that male member 6 is separated from female member 5, and therefore, engaging pieces 20 and 21 move toward the opening 10 side of female member 5.

When engaging pieces 20 and 21 move toward inclined guide surfaces 24 and 25, engaging pieces 20 and 21 at the front and rear recover their form and move away from each other, and inserting portion 18 moves outward due to the elastic force of engaging pieces 20 and 21 and the momentum of engaging pieces 20 and 21 returning to their original form while making contact with inclined guide surfaces 24 and 25, so that male member 6 springs out in such a direction as to be separated from female member 5. At this time, engaging pieces 20 and 21 are guided in a state of contact with parallel guide surfaces 22 and 23 in the front-rear direction, and therefore, inserting portion 18 moves straight to the outside from female member 5, and separation of male member 6 from female member 5 can be smoothly carried out without inserting portion 18 and engaging pieces 20 and 21 being caught on the inside of female member 5.

As described above, in buckle 1 according to the present embodiment of the present invention, engaging piece 20 for engaging slit 13 that is created in front plate portion 7 and engaging piece 21 for engaging slit 14 that is created in rear plate portion 8 are released from the engaged state when pressed by separately provided operating pieces 11 and 12, and therefore, even in the case where one operating piece 11 (or 12) provided on the front plate portion 7 side (or the rear plate portion 8 side) is pressed so that the engaged state between one slit 13 (or 14) and engaging piece 20 (or 21) is released, the engaged state of the other slit 14 (or 13) and engaging piece 21 (or 20) is maintained. Therefore, even if one operating piece 11 (or 12) is accidentally pressed, so that the engaged state between one slit 13 (or 14) and engaging piece 20 (or 21) is released, the engaged state between the other slit 14 (or 13) and engaging piece 21 (or 20) is maintained, and therefore, the connected state between female member 5 and male member 6 can be prevented from being released without the user's intent.

In addition, operating piece, 11 which is a first operating portion, and operating piece 12, which is a second operating portion, are provided on the front and rear of female member 5, and therefore, the two operating portions 11 and 12 are pressed in such a manner that female member 5 is pinched in the front-rear direction, and thereby, male member 5 and female member 6 can be easily converted to a separated state.

In addition, operating pieces 11 and 12 are provided so as to freely press engaging pieces 20 and 21 via slits 13 and 14 which are created in front plate portion 7 and rear plate portion 8 and engage with the inner peripheral surface of slits 13 and 14 in a connected state, and therefore, the form of front plate portion 7 and rear plate portion 8 is simple, in comparison with a case where engaging portions with which engaging pieces 20 and 21 engage and slits 13*a* and 14 are separately created, and therefore, molding of the buckle becomes easy, and in addition, engaging portions 13 and 14 are formed in the vicinity of respective operating pieces 11 and 12, and therefore, engagement between engaging portions 13 and 14 and engaging pieces 11 and 12, respectively, can be released without fail.

Furthermore, these operating pieces 11 and 12 are pressed outward by engaging pieces 20 and 21 in such a state that they engage slits 13 and 14, and thereby, a state where engaging pieces 20 and 21 are engaged with slits 13 and 14 can be maintained in a state where operating pieces 11 and 12 are pressed outward by engaging pieces 20 and 21, respectively, due to elastic recoil, and respective operating piece 11 and 12 can be prevented from sinking inward into female member 5, and thus, the operation of pressing respective operating pieces 11 and 12 becomes easy.

In addition, engaging pieces 20 and 21 are formed by splitting the end portion of an elastic piece that is formed in inserting portion 18 into two branches in the front-rear direction, and thus, these engaging pieces 20 above described 21 are integrated at the base, and therefore, when one engaging piece 20 (or 21) is pressed inward through operation, the other engaging piece 21 (or 20) is pressed in such a direction as to engage with slit 14 (or 13), that is to say, toward the rear side (or the front side), making engagement deeper, and therefore, when only one engaging piece 20 (or 21) is pressed, engagement of the other engaging piece 21 (or 20) and slit 14 (or 13) is effectively prevented from being released.

In addition, operating pieces 11 and 12 bulge out (in the front-rear direction), and thereby, when the user pinches female member 5 in the front-rear direction with his fingers so as to press operating pieces 11 and 12 in order to separate female member 5 from male member 6, and operating piece 11 is pressed to the same level as the surface of front plate portion 7, and operating piece 12 is pressed to the same level as the surface of rear plate portion 8 (see FIG. 7), engaging pieces 20 and 21 become of a disengaged state from slits 13 and 14, and thus, the user can press down operating pieces 11 and 12 through operation with his fingers without pressing operating pieces 11 and 12 to the inside below the surface of front plate portion 7 and rear plate portion 8, making the operation of separating female member 5 from male member 6 easy.

Furthermore, the front and rear of female member 5 and male member 6 are symmetrical, and thereby, female member 5 and male member 6 are easy to manufacture, and inserting portion 18 can be inserted into female member 5 when the front and rear surfaces of male member 6 are reversed, and in addition, operating pieces 11 and 12 at the front and rear can be operated with the same pressing force, making buckle 1 easy to use.

Though embodiments of the present invention are described in the above in reference to the drawings, the concrete configuration is not limited to these embodiments and modifications and additions within such a scope as not to deviate from the gist of the present invention are included in the present invention.

For example, though the form in the front and rear of female member 5 and male member 6 is symmetrical in a cross section according to the above described embodiments, it is not necessary for the form in the front and rear to be symmetrical in a cross section, and operating piece 11 that is formed in front plate portion 7 and operating piece 12 that is formed in the rear plate portion 8 may have different forms.

In addition, though in the above described embodiments, operating pieces 11 and 12 are formed on the two surfaces; on front plate portion 7 and rear plate portion 8 in female member 5, as first and second operating portions, it is not necessary to form operating pieces 11 and 12, and slits 13 and 14 may be created as through holes in circular form, and these may be used as first and second operating portions, in such a manner that the user directly inserts his fingers from the outside through these through holes and directly presses respective engaging pieces 20 and 21 through operation, thereby releasing the engaged state between engaging pieces 20 and 21.

In addition, though in the above described embodiments, male member 6 and female member 5 do not become of a separated state unless engagement between engaging piece 20, which is a first engaging piece, and slit 13, which is a first engaging portion, as well between engaging piece 21, which is a second engaging piece, and slit 14, which is a second engaging portion, is released at the same time, the engagement between these engaging pieces 20 and 21 and slits 13 and 14 may, for example, have a predetermined depth, so that the engagement between engaging pieces 20 and 21 and slits 13 and 14 are forcibly released when a force of no less than a predetermined level is applied in such a direction as to separate male member 6 from female member 5, without releasing the engagement via operating pieces 11 and 12, and in this case, when a strong tensile force is applied to buckle 1 (for example in the case where cellular phone 3 is caught on something), this force can be prevented from being conveyed to and hurting the user, and thus, the safety is increased.

In addition, in buckle 1 described in the above embodiments, members in string form, for example strap 2 and connecting string 4, are attached to end portions of male member 6 and female member 5 in such a manner that these serve as a connecting jig for connecting (linking) strap 2 for connecting string 4 as described above, the buckle according to the present invention is not limited to being for connecting members in string form, for example straps and connecting strings as those described above, or belts, that is to say, or for attaching a member in string form in a location other than an end where an inserting portion or an opening is created, and may be, for example, a buckle where a supporting portion, such as clip, a hook or a karabiner, is provided (attached) to at least either the male member or the female member, or a buckle where the main body of the male member or female member is formed of a clip, a hook or a karabiner.

What is claimed is:

1. A buckle, comprising a female member in approximately flat cylindrical form having a front plate portion and a rear plate portion with an opening created at one end, and a male member having an inserting portion for inserting into said female member through said opening formed at one end, wherein:

a first engaging piece that elastically engages a first engaging portion that is formed on the inside of said front plate portion, and a second engaging piece that elastically engages a second engaging portion that is formed on the inside of said rear plate portion are formed on said inserting portion; a first operating portion that can be operated so that said first engaging piece is pressed from the outside and engagement with said first engaging portion is released is provided in said front plate portion, and a second operating portion that can be operated so that said second engaging piece is pressed from the outside and engagement with said second engaging portion is released is provided in said rear plate portion separately from said first operating portion, so that said male member and said female member do not become of a separated state unless engagement between said first engaging piece and said first engaging portion, as well as engagement between said second engaging piece and said second engaging portion, are released via both of said operating portion and said second operating portion, wherein said first operating portion is formed of a first operating piece that is provided in such a manner that the first operating piece can freely press said first engaging piece because of a slit created in said front plate portion, said second operating portion is formed of a second operating piece that is provided in such a manner that the second operating piece can freely press said second engaging piece because of a slit created in said rear plate portion, and said first engaging portion and said second engaging portion are formed of an inner peripheral surface of said slits, and said slits are created in approximately circular form and the ends of said first engaging piece and said second engaging piece have a curved form with a curvature that is approximately the same as the curvature of said slits.

2. The buckle according to claim 1, wherein said first operating piece is pressed outwards by said first engaging piece in an engaged state with said slit, and said second operating piece is pressed outwards by said second engaging piece in an engaged state with said slit.

3. The buckle according to claim 1, wherein said first engaging piece and said second engaging piece are formed by splitting the end portion of an elastic piece that is formed in said inserting portion into two branches in the front-rear direction.

4. The buckle according to claim 1, wherein said female member and said male member are formed in such a manner that the form of the front and rear is symmetrical in a cross section.

* * * * *